United States Patent [19]

Nazmy

[11] Patent Number: 4,795,507

[45] Date of Patent: Jan. 3, 1989

[54] PROCESS FOR INCREASING THE ROOM-TEMPERATURE DUCTILITY OF A WORKPIECE COMPOSED OF AN OXIDE-DISPERSION-HARDENED NICKEL BASED SUPERALLOY AND EXISTING AS COARSE, LONGITUDINALLY ORIENTED COLUMNAR CRYSTALLITES

[75] Inventor: Mohamed Y. Nazmy, Fislisbach, Switzerland

[73] Assignee: BBC Brown Boveri AG, Baden, Switzerland

[21] Appl. No.: 131,361

[22] Filed: Dec. 10, 1987

[30] Foreign Application Priority Data

Dec. 19, 1986 [CH] Switzerland ..... 5111/86

[51] Int. Cl.[4] ..... B22F 5/04

[52] U.S. Cl. ..... 148/11.5 N; 148/11.5 P; 148/162

[58] Field of Search ..... 148/11.5 P, 11.5 N, 148/162

[56] References Cited

U.S. PATENT DOCUMENTS

| | | | |
|---|---|---|---|
| 4,502,896 | 3/1985 | Duerig et al. | 148/11.5 N |
| 4,518,442 | 5/1985 | Chin | 148/11.5 N |
| 4,531,981, | 7/1985 | Singer | 148/11.5 N |

*Primary Examiner*—Wayland Stallard

*Attorney, Agent, or Firm*—Oblon, Fisher, Spivak, McCelland & Maier

[57] ABSTRACT

Process for increasing the room-temperature ductility of a workpiece composed of oxide-dispersion-hardened nickel-base superalloy and existing as coarse, longitudinally oriented columnar crystallites by subjecting the previously zone-annealed workpiece to a solution anneal in the temperature range between 1,160° and 1,280° C. under argon atmosphere for ½ h to 5 h and then to a purposefully chosen cooling down at a rate of 0.1° C./min to 5° C./min to a temperature of 500° to 700° C. Thereafter the workpiece is cooled down to room temperature in air. Preferred purposefully chosen cooling down rate: approx. 0.5° C./min.

4 Claims, 1 Drawing Sheet

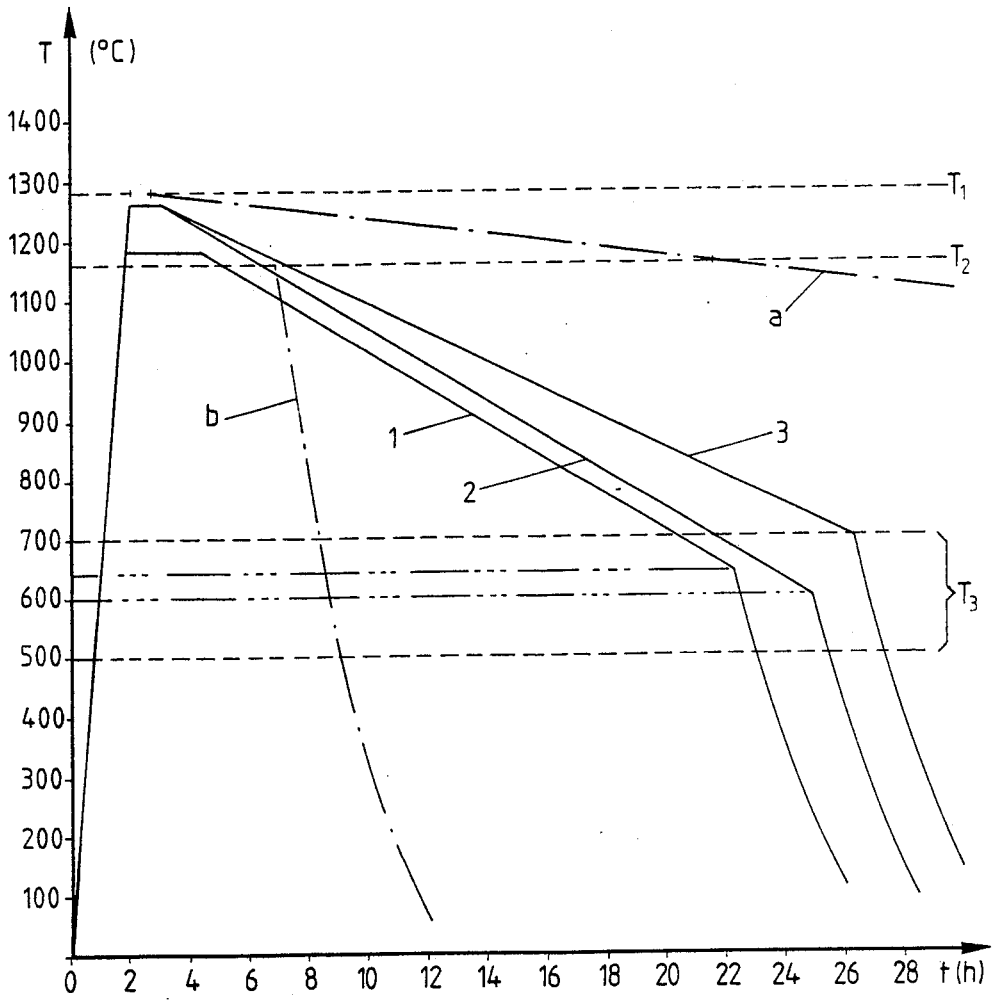
T (°C)
1400
1300
1200
1100
1000
900
800
700
600
500
400
300
200
100
0
2
4
6
8
10
12
14
16
18
20
22
24
26
28
t (h)
T1
T2
T3
a
b
1
2
3

PROCESS FOR INCREASING THE ROOM-TEMPERATURE DUCTILITY OF A WORKPIECE COMPOSED OF AN OXIDE-DISPERSION-HARDENED NICKEL BASED SUPERALLOY AND EXISTING AS COARSE, LONGITUDINALLY ORIENTED COLUMNAR CRYSTALLITES

DESCRIPTION

Process for increasing the room-temperature ductility of a workpiece composed of an oxide-dispersion-hardened nickel based superalloy and existing as coarse, longitudinally oriented columnar crystallites

TECHNICAL FIELD

Oxide-dispersion-hardened superalloys based on nickel which, owing to their outstanding mechanical properties at high temperatures, are used in the construction of heat engines. Preferred use as blade material for gas turbines.

The invention relates to the improvement of the mechanical properties of oxide-dispersion-hardened nickel-base superalloys having by and large optimum properties in relation to high-temperature strength, long-term stability and ductility.

In particular it relates to a process for increasing the room-temperature ductility of a workpiece composed of oxide-dispersion-hardened nickel-base superalloy and existing as coarse, longitudinally oriented columnar crystallites, the workpiece being produced by powder metallurgy, extruded or forged or hot isostatically pressed and then zone-annealed.

PRIOR ART

The following literature is cited on the prior art:

G. H. Gessinger, Powder Metallurgy of Superalloys, Butterworths, London, 1984

R. F. Singer and E. Arzt, to be published in: Conf. Proc. "High Temperature Materials for Gas Turbines", Liège, Belgium, October 1986

J. S. Benjamin, Metall. Trans. 1970, 1, 2943–2951

M. Y. Nazmy and R. F. Singer, Effect of inclusions on tensile ductility of a nickel-base oxide dispersion strengthened superalloy, Scripta Metallurgica, Vol. 19, pp. 829–832, 1985, Pergamon Press Ltd.

T. K. Glasgow, "Longitudinal Shear Behaviour of Several Oxide Dispersion Strengthened Alloys", NASA TM-78973 (1978).

Oxide-dispersion-hardened nickel-base superalloys are remarkable for high-temperature strength, in particular creep strength and fatigue strength at maximum working temperatures. In lower temperature ranges, in particular at room temperature, these alloys are, however, comparatively brittle and, in addition, have a low shear strength compared with conventional high-temperature alloys. This makes their use as blade material in gas-turbine construction difficult since a rotor blade is, as a rule, exposed to very different complex thermal and mechanical stresses as a function of time and place. In particular the root of the blade, usually a type of "Christmas-tree" structure, for the purpose of anchoring in the rotary body, is always subject to tensile, compressive and shear stresses and particularly endangered as a result of this. In addition, it should be able to take deformations upon itself in order to be able to adapt to the operating conditions. The material to be used must therefore have a certain minimum ductility and shear strength.

There is therefore a need to largely eliminate the above deficiencies and to disclose methods of improving the material behavior during operation.

DESCRIPTION OF THE INVENTION

The invention is based on the object of providing a process for improving the ductility of a workpiece composed of a coarse-grain oxide-dispersion-hardened nickel-base superalloy which can be simply carried out and does not impair the other material properties, in particular in the high-temperature range. The method should, in particular, substantially increase the comparatively low ductility, in the transverse direction of the longitudinally oriented columnar crystallites. This should therefore achieve an increase in the shear strength.

This object is achieved, in the process mentioned in the introduction, by subjecting the workpiece after the zone annealing to a solution anneal at a temperature between 1,160° and 1,280° C. for ½ to 5 hours under argon atmosphere and then cooling down to a temperature of 500° to 700° C. at a rate between 0.1° C./min and 5° C./min and thereafter cooling down in air to room temperature.

The majority of the commercially used oxide-dispersion-hardened nickel-base superalloys contains, in addition to the dispersoids, the known $\gamma'$-phase in finely divided precipitations. It has been possible to show that the ductility, in particular in the low temperature range (for example, at room temperature) is substantially dependent on the quantity, form and distribution of said $\gamma'$-phase. It is therefore a matter of converting said phase to a suitable form or dissolving it in the matrix, and this can be done, according to the invention, by means of the abovementioned heat treatment and appropriate cooling down of the workpiece. Since the high-temperature properties of the oxide-dispersion-hardened alloys are determined mainly by the dispersoids, creep limit and fatigue strength are not disadvantageously affected by the at least partial solution of the $\gamma'$-phase in the matrix taking account of the maximum temperature of use of the

METHOD OF IMPLEMENTING THE INVENTION

The invention is described by reference to the exemplary embodiments explained in more detail by a FIGURE:

Here the FIGURE shows:

A diagram of the temperature curve as a function of time while the process is being carried out. $T_1$ is the maximum permissible solution temperature for the $\gamma'$-phase in the $\gamma$-matrix, which is determined by the melting point of the lowest-melting phase of the superalloy. In order to reliably prevent an incipient melting of said phase, $T_1$ must still be below the lowest melting point (solidus point) of the alloy by a value of approx. 10° C. $T_2$ is the minimum necessary solution-anneal temperature for the $\gamma'$-phase in the $\gamma$-matrix. Here it is assumed that, after a finite time which is acceptable in operation (i.e. after a few hours), the total mass of the $\gamma'$-phase has gone into solid solution in the $\gamma$-matrix. a is the upper limit of the temperature curve for the slow cooling down of the workpiece which is determined by practical operating conditions. A still slower cooling down would be uneconomical and is not necessary. b is the lower limit of the temperature curve for the slow cooling down of the workpiece. A more rapid cooling down is not permissible since, under these circumstances, at least a portion of the γ'-phase which is in solution would precipitate again. Curve 1 relates to the temperature curve for the heat-treatment of the material MA 6000 as described in Example 1, curve 2 to that of MA 6000 as described in Example 2. The temperature curve according to curve 3 relates to a workpiece of the alloy as described in Example 3.

EXEMPLARY EMBODIMENT 1

See curve 1 of the FIGURE!

A prism-shaped sample 180 mm long, 50 mm wide and 12 mm thick was machined from an oxide-dispersion-hardened nickel-base alloy having the trade name MA 6000 (INCO). The material had the following composition:

Cr=15% by weight,
W=4.0% by weight,
Mo=2.0% by weight,
Al=4.5% by weight,
Ti=2.5% by weight,
Ta=2.0% by weight,
C=0.05% by weight,
B=0.01% by weight,
Zr=0.15% by weight,
$Y_2O_3$=1.1% by weight,
Ni=remainder.

The starting material had undergone the following thermomechanical and thermal treatment at the manufacturers:

hot extrusion,
hot rolling,
zone annealing to elongated coarse grain at 1,270° C.,
annealing at 1,230° C.: ½ h, cooling down in air,
annealing at 955° C./2 h, cooling down in air,
annealing at 845° C./24 h, cooling down in air.

The mechanical properties of the material in the delivered state, which was in the form of elongated crystallites, were determined to be as follows (values at room temperature in the long transverse direction of the crystallites):

yield point (0.2%): 1,095 MPa,
tensile strength: 1,187 MPa,
elongation: 2.48%.

The workpiece was then subjected to a heat treatment as follows:

heating under argon atmosphere up to 1,180° C.,
solution annealing at 1,180° C. for 2½ h,
cooling down to 640° C. at a rate of 0.5° C./min,
cooling to room temperature in air.

After this treatment the mechanical properties turned out to be as follows (values at room temperature in the long transverse direction of the crystallites):

yield point (0.2%): 930 MPa,
tensile strength: 1,147 MPa,
elongation: 4.30%.

EXEMPLARY EMBODIMENT 2

See curve 2 of the FIGURE!

A gas turbine blade having the following dimensions of the blade foil (bearing wing profile) was machined from nickel-based alloy MA 6000 having the composition as described in Example 1:

height=160 mm,
width=40 mm,
maximum thickness=8 mm,
profile height=13 mm.

The starting material had undergone the following thermomechanical and thermal treatments at the manufacturers:

hot extrusion,
zone annealing to longitudinal coarse grain at 1,270° C.

The mechanical properties of the material in the delivered state, which was in the form of elongated crystallites, were determined to be as follows (values at room temperature):

In the longitudinal direction of the crystallites:
yield point (0.2%): 1,186 MPa,
tensile strength: 1,210 MPa,
elongation: 1.37%.

In the transverse direction of the crystallites:
yield point (0.2%): 1,228 MPa,
tensile strength: 1,232 MPa,
elongation: 0.33%.

The workpiece was then subjected to a heat treatment as follows:

heating under argon atmosphere up to 1,260° C.,
solution annealing at 1,260° C. for 1 h,
cooling down to 600° C. at a rate of 0.5° C./min,
cooling down to room temperature in air.

After this treatment the mechanical properties turned out to be as follows (values at room temperature):

In the longitudinal direction of the crystallites:
yield point (0.2%): 1,028 MPa,
tensile strength: 1,200 MPa,
elgonation: 5.37%.

In the transverse direction of the crystallites:
yield point (0.2%): 1,038 MPa,
tensile strength: 1,165 MPa,
elongation: 1.97%.

EXEMPLARY EMBODIMENT 3

See curve 3 of the FIGURE!

A prism-shaped sample 120 mm long, 40 mm wide and 10 mm thick was machined from an oxide-dispersion-hardened nickel-base alloy. The material had the following composition.

Cr=19.6% by weight,
W=3.6% by weight,
Mo=2.0% by weight,
Al=6.0% by weight,
Fe=1.4% by weight,
C=0.04% by weight,
B=0.017% by weight,
Zr=0.12% by weight,
$Y_2O_3$=1.1% by weight,
Ni=remainder.

The starting material had undergone the following thermomechanical and thermal treatments at the manufacturers:

hot extrusion,
zone annealing to elongated coarse grain 1,260° C.,
annealing at 1,230° C./½ h, cooling down in air,
annealing at 955° C./2 h, cooling down in air,
annealing at 845°4C./24 h, cooling down in air.

The mechanical properties of the material as delivered, which was in the form of elongated crystallites, were determined to be as follows (values at room temperature in the transverse direction of the crystallites):

yield point (0.2%): 1,216 MPa,
tensile strength: 1,348 MPa,
elongation: 0.41%.

The workpiece was then subjected to a heat treatment as follows:

heating under argon atmosphere up to 1,260° C.,
solution annealing at 1,260° C. for 1 h,
cooling down to 700° C. at a rate of 0.4° C./min,
cooling down to room temperature in air.

After this treatment, the mechanical properties turned out to be as follows (values at room temperature in the longitudinal direction of the crystallites):

yield point (0.2%): 1,095 MPa,
tensile strength: 1,221 MPa,
elongation: 1.29%.

The invention is not limited to the exemplary embodiments. The choice of solution annealing temperature for this type of oxide-dispersion-hardened nickel-base superalloy may be within the limits of $T_2$ (1,160° C.) and $T_1$ (1,280° C.). Depending on the workpiece and the operational requirements, the duration of the solution anneal is preferably between ½ h and 5 h. The choice of rate of cooling down during the cooling down process after the solution anneal may be within the limits of 5° C./min and 0.1° C./min. Preferred are approximately 0.5° C./min. The lower temperature $T_3$ to which the heat treatment should be carried out with a defined rate of cooling may be chosen freely between the limits of 500° and 700° C.

For the examples it emerges that it was possible to increase the elongation, found at room temperature in the tensile test, of the finished workpiece in the longitudinal direction of the columnar crystallites up to approximately twice, and in the long transverse direction on average up to about five times. Further tests revealed that a substantial increase in the ductility is also associated with this.

I claim:

1. A process for increasing the room-temperature ductility of a workpiece composed of oxide-dispersion-hardened nickel-base superalloy and existing as coarse, longitudinally oriented columnar crystallites, the workpiece having been produced by powder metallurgy, extruded or forged or hot isostatically pressed and then zone-annealed, which comprises subjecting the workpiece after the zone annealing to a solution anneal at a temperature between 1,160° C. and 1,280° C. for ½ to 5 h under argon atmosphere and then cooling down to a temperature of 500° to 700° C. at a rate between 0.1° C./min and 5° C./min and thereafter cooling down in air to room temperature.

2. The process as claimed in claim 1, wherein the workpiece consists of a material of the following composition:

Cr=15.0% by weight,
W=4.0% by weight,
Mo=2.0% by weight,
Al=4.5% by weight,
Ti=2.5% by weight,
Ta=2.0% by weight,
C=0.05% by weight,
B=0.01% by weight,
Zr=0.15% by weight,
$Y_2O_3$=1.1% by weight,
Ni=remainder, and wherein the workpiece is subjected to a solution anneal at a temperature of 1,260° C. under argon atmosphere for 1 h and then cooled down at a rate of 0.5° C./min to a temperature of 500° to 700° C. and thereafter cooled down to room temperature in air.

3. The process as claimed in claim 1, wherein the workpiece consists of a material of the following composition:

Cr=15.0% by weight,
W=4.0% by weight,
Mo=2.0% by weight,
Al=4.5% by weight,
Ti=2.5% by weight,
Ta=2.0% by weight,
C=0.05% by weight,
B=0.01% by weight,
Zr=0.15% by weight,
$Y_2O_3$=1.1% by weight,
Ni=remainder, and wherein the workpiece is subjected to a solution anneal at a temperature of 1,180° C. under argon atmosphere for 2½ h and then cooled down at a rate of 0.5° C./min to a temperature of 500° to 700° C. and thereafter cooled down to room temperature in air.

4. The process as claimed in claim 1, wherein the workpiece consists of a material of the following composition:

Cr=19.6% by weight,
W=3.6% by weight,
Mo=2.0% by weight,
Al=6.0% by weight,
Fe=1.4% by weight,
C=0.04% by weight,
B=0.017% by weight,
Zr=0.12% by weight,
$Y_2O_3$=1.1% by weight,
Ni=remainder, and wherein the workpiece is subjected to a solution anneal at a temperatue of 1,260° C. under argon atmosphere for 1 h and then cooled down at a rate of 0.4° C./min to a temperature of 500° to 700° C. and thereafter cooled down to room temperature in air.

* * * * *